US012723529B2

(12) United States Patent
Ogura et al.

(10) Patent No.: US 12,723,529 B2
(45) Date of Patent: Sep. 1, 2026

(54) EXHAUST GAS PURIFICATION APPARATUS

(71) Applicant: Isuzu Motors Limited, Yokohama (JP)

(72) Inventors: Shohei Ogura, Fujisawa (JP); Kenji Fujii, Fujisawa (JP)

(73) Assignee: Isuzu Motors Limited, Yokohama (JP)

( * ) Notice: Subject to any disclaimer, the term of this patent is extended or adjusted under 35 U.S.C. 154(b) by 0 days.

(21) Appl. No.: 18/985,121

(22) Filed: Dec. 18, 2024

(65) Prior Publication Data

US 2025/0223915 A1 Jul. 10, 2025

(30) Foreign Application Priority Data

Jan. 5, 2024 (JP) ..... 2024-000633

(51) Int. Cl.
*F01N 3/10* (2006.01)
*F01N 3/08* (2006.01)
*F01N 3/20* (2006.01)

(52) U.S. Cl.
CPC ..... *F01N 3/108* (2013.01); *F01N 3/2066* (2013.01); *F01N 3/0807* (2013.01); *F01N 3/206* (2013.01); *F01N 3/208* (2013.01); *F01N 2570/18* (2013.01); *F01N 2900/1616* (2013.01)

(58) Field of Classification Search
CPC ..... F01N 3/021; F01N 3/035; F01N 3/0807; F01N 3/0814; F01N 3/0821; F01N 3/0842; F01N 3/0885; F01N 3/108; F01N 3/206; F01N 3/2066; F01N 3/208; F01N 13/009; F01N 13/0093; F01N 2240/25; F01N 2250/14; F01N 2570/18; F01N 2900/1614; F01N 2900/1616
See application file for complete search history.

(56) References Cited

U.S. PATENT DOCUMENTS

| | | | | |
|---|---|---|---|---|
| 10,480,369 | B1 * | 11/2019 | Dahodwala | F01N 3/106 |
| 2007/0012032 | A1 * | 1/2007 | Hu | F01N 3/0842 60/301 |
| 2011/0011067 | A1 * | 1/2011 | Ren | B01D 46/2418 60/297 |
| 2013/0111886 | A1 * | 5/2013 | Gonze | F01N 3/2013 60/286 |
| 2016/0230632 | A1 * | 8/2016 | Smith | F01N 3/0842 |
| 2017/0074191 | A1 * | 3/2017 | Kim | F01N 3/2066 |
| 2019/0242282 | A1 * | 8/2019 | Li | F01N 13/009 |
| 2020/0224576 | A1 * | 7/2020 | Dou | F01N 3/36 |
| 2021/0047954 | A1 * | 2/2021 | Keppeler | B01D 53/90 |
| 2022/0112825 | A1 * | 4/2022 | Magnusson | F01N 3/2066 |

FOREIGN PATENT DOCUMENTS

| | | |
|---|---|---|
| JP | 2020-045884 | 3/2020 |
| JP | 2021-148068 | 9/2021 |

* cited by examiner

*Primary Examiner* — Binh Q Tran

(57) ABSTRACT

The exhaust gas purification apparatus in the present disclosure is an exhaust gas exhaust purification apparatus that purifies exhaust gas discharged from an internal combustion engine, and includes, in order from an upstream side in a flow direction of the exhaust gas in an exhaust pipe: a first selective catalytic reduction catalyst; an NOx adsorption catalyst; and a second selective catalytic reduction catalyst.

2 Claims, 5 Drawing Sheets

EXHAUST GAS PURIFICATION APPARATUS

CROSS REFERENCE TO RELATED APPLICATIONS

This application claims the benefit of priority of Japanese Patent Application No. 2024-000633, filed on Jan. 5, 2024, the disclosure of which including the specification, drawings and abstract is incorporated herein by reference in its entirety.

TECHNICAL FIELD

The present disclosure relates to an exhaust gas purification apparatus.

BACKGROUND ART

With respect to the existing exhaust gas control, a configuration in which a diesel oxidation catalyst (DOC), a diesel particulate filter (DPF), and a selective catalytic reduction (SCR) catalyst are arranged in order from the upstream side of exhaust gas has been widely adopted for exhaust gas purification apparatuses (for example, see Patent Literature (hereinafter referred to as "PTL") 1).

Although the activation of an SCR catalyst used in NOx purification needs temperature, a higher-order exhaust gas control which is scheduled to be enforced going forward requires NOx emissions to be suppressed at the time of a low temperature. The problem is, however, that the aforementioned configuration does not make it possible to obtain a temperature sufficient for the activation of an SCR catalyst.

In this respect, a configuration in which an SCR catalyst is added to the upstream side of a DOC (see FIG. 2 to be described later) has been devised with respect to the foregoing configuration, and some exhaust gas purification apparatuses having the above configuration are mass-produced.

CITATION LIST

Patent Literature

PTL 1

Japanese Patent Application Laid-Open No. 2021-148068

SUMMARY OF INVENTION

Technical Problem

Nonetheless, the configuration in which an SCR catalyst is added to the upstream side of a DOC also has a problem in that NOx emissions cannot be effectively suppressed since the SCR catalyst is not activated in a very low temperature range.

An object of an aspect of the present disclosure is to provide an exhaust gas purification apparatus capable of suppressing NOx emissions at the time of a low temperature more effectively.

Solution to Problem

An exhaust gas purification apparatus according to an aspect of the present disclosure is an exhaust gas purification apparatus that purifies exhaust gas discharged from an internal combustion engine, and includes, in order from an upstream side in a flow direction of the exhaust gas in an exhaust pipe: a first selective catalytic reduction catalyst; an NOx adsorption catalyst; and a second selective catalytic reduction catalyst.

Advantageous Effects of Invention

According to the present disclosure, it is possible to suppress NOx emissions at the time of a low temperature more effectively.

DESCRIPTION OF EMBODIMENTS

Hereinafter, an embodiment of the present disclosure will be described with reference to the accompanying drawings.

Figure 1:
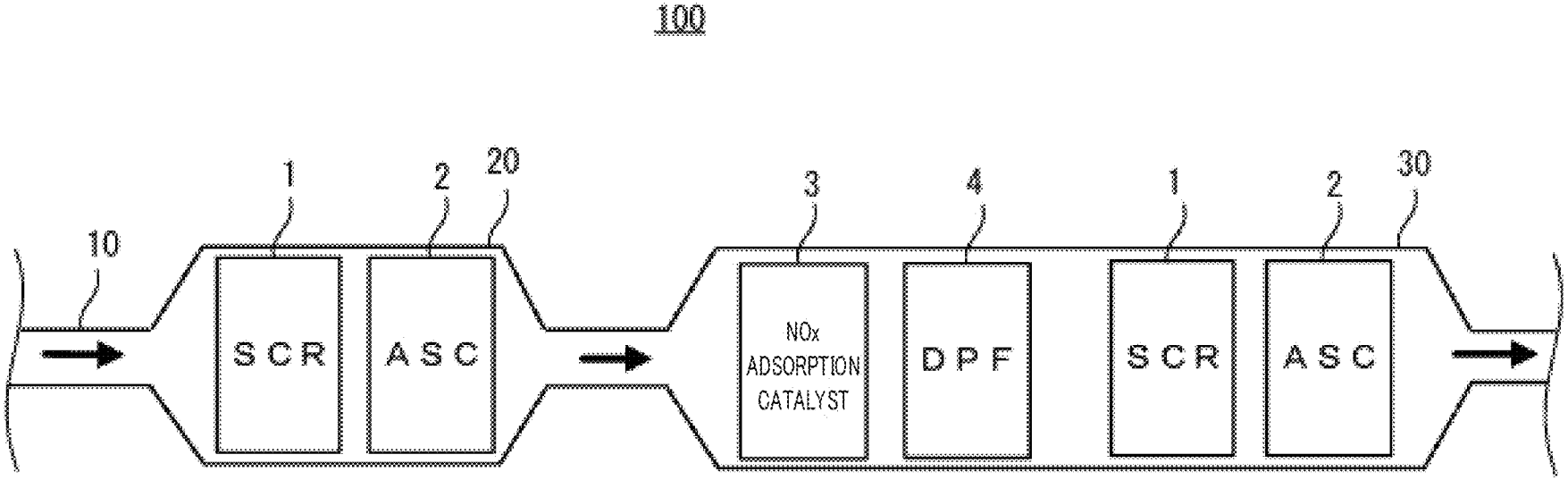
FIG. 1 schematically illustrates the configuration of an exhaust gas purification apparatus according to an embodiment of the present disclosure.

First, the configuration of exhaust gas purification apparatus 100 according to the present embodiment will be described with reference to FIG. 1. FIG. 1 is a schematic diagram illustrating the configuration of exhaust gas purification apparatus 100.

Exhaust gas purification apparatus 100 is, for example, an apparatus that is mounted in a vehicle (illustration is omitted) and purifies exhaust gas discharged from the internal combustion engine (illustration is omitted) of the vehicle. Although a diesel engine is assumed as the internal combustion engine in the present embodiment, the present disclosure is not limited thereto. Further, exhaust gas purification apparatus 100 is not only applied to the internal combustion engine of a vehicle, but may also be applied to the internal combustion engine of a ship or a stationary internal combustion engine, for example.

The upstream side of exhaust pipe 10 (the left side in the figure) is connected to the downstream side of an exhaust manifold (illustration is omitted) connected to the internal combustion engine, or is connected to the outlet side of a turbine housing (illustration is omitted) of a turbocharger. In FIG. 1, exhaust gas flows through exhaust pipe 10 from the left side to the right side in the figure (see the arrows in the figure), and is ultimately discharged into the outside of the vehicle.

Exhaust pipe 10 is provided with catalytic converter 20 and catalytic converter 30 in order from the upstream side of exhaust pipe 10. Note that, a catalytic converter may be referred to as "catalyst canning" or "catalyst case".

Catalytic converter 20 is provided with SCR catalyst 1 and ammonia slip catalyst (ASC) 2 in order from the upstream side of catalytic converter 20.

Catalytic converter 30 is provided with NOx adsorption catalyst 3, DPF 4, SCR catalyst 1, and ASC 2 in order from the upstream side of catalytic converter 30.

SCR catalyst 1 adsorbs ammonia generated by hydrolysis of urea water as a reducing agent, thereby reducing NOx in exhaust gas to nitrogen and water. Note that, the urea water is injected into catalytic converters 20 and 30 by a urea water injection apparatus (illustration is omitted) provided on the upstream side of SCR catalyst 1. The injected urea water is hydrolyzed to ammonia by the heat of exhaust gas.

ASC 2 oxides and decomposes ammonia which has not been fully consumed by SCR catalyst 1. Thus, it is possible to prevent ammonia from being discharged into the atmosphere.

NOx adsorption catalyst 3 has the properties that its NOx adsorption capacity is large when the catalyst temperature is low, and that its NOx adsorption capacity decreases as the catalyst temperature rises. Thus, in a situation in which the temperature of exhaust gas is low, NOx adsorption catalyst 3 adsorbs NOx in the exhaust gas, and releases the adsorbed NOx as the temperature of the exhaust gas rises.

DPF 4 collects particulate matter in exhaust gas.

Note that, SCR catalyst 1 in catalytic converter 20 is an example of the "first selective catalytic reduction catalyst", and SCR catalyst 1 in catalytic converter 30 is an example of the "second selective catalytic reduction catalyst". In addition, ASC 2 in catalytic converter 20 is an example of the "first ammonia slip catalyst", and ASC 2 in catalytic converter 30 is an example of the "second ammonia slip catalyst". Further, DPF 4 is an example of the "particulate filter".

The configuration of exhaust gas purification apparatus 100 in the present embodiment has been described above.

Next, the configurations of exhaust gas purification apparatuses 101 to 103 serving as comparative examples for exhaust gas purification apparatus 100 in the present embodiment will be described with reference to FIGS. 2 to 4. Note that, in FIGS. 2 to 4, the same components as those in FIG. 1 are denoted by the same reference signs, and detailed description thereof will be omitted below.

Figure 2:
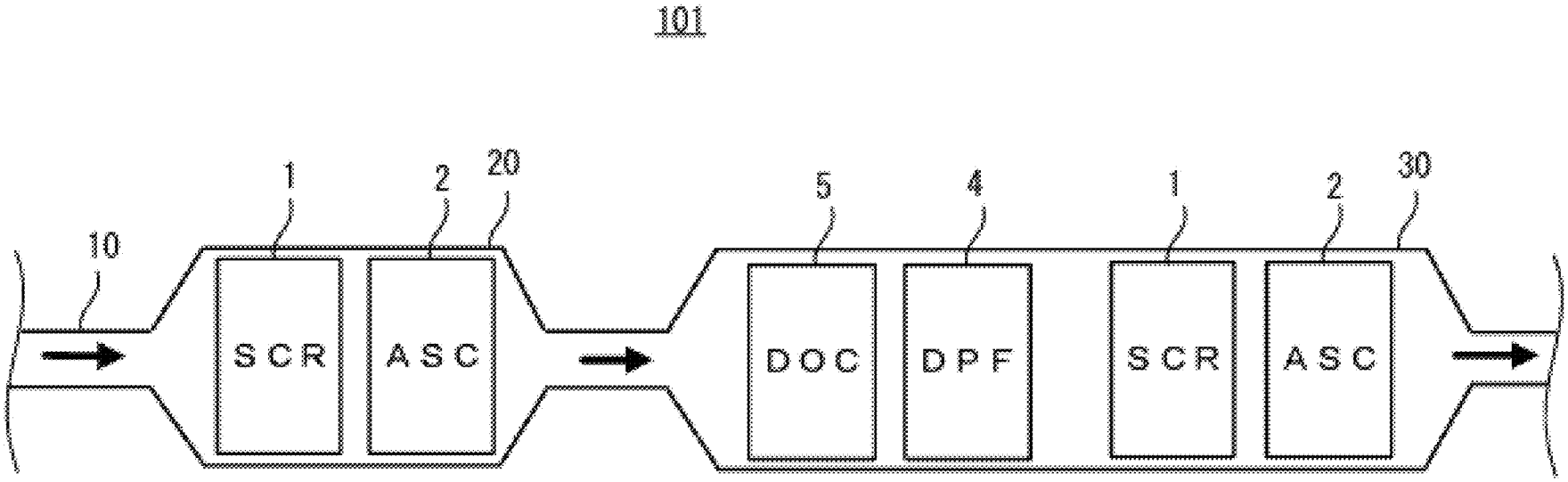
FIG. 2 schematically illustrates the configuration of an exhaust gas purification apparatus according to Comparative Example 1 of the present disclosure.

FIG. 2 is a schematic diagram illustrating the configuration of exhaust gas purification apparatus 101 as Comparative Example 1. Exhaust gas purification apparatus 101 in FIG. 2 differs from exhaust gas purification apparatus 100 in FIG. 1 in that exhaust gas purification apparatus 101 includes DOC 5 (an exemplary oxidation catalyst), instead of NOx adsorption catalyst 3, in catalytic converter 30. DOC 5 decomposes and removes hydrocarbon and carbon monoxide in exhaust gas.

Figure 3:
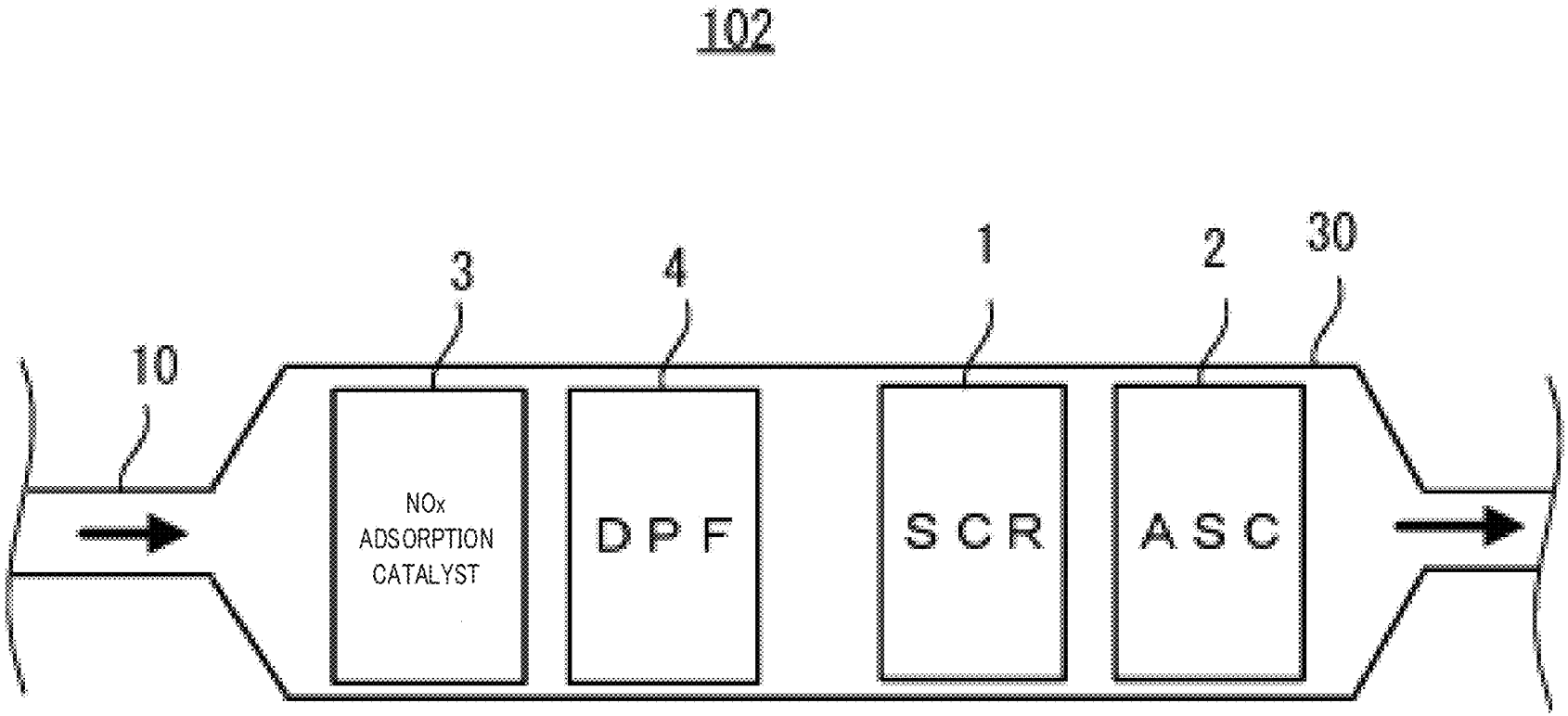
FIG. 3 schematically illustrates the configuration of an exhaust gas purification apparatus according to Comparative Example 2 of the present disclosure.

FIG. 3 is a schematic diagram illustrating the configuration of exhaust gas purification apparatus 102 as Comparative Example 2. Exhaust gas purification apparatus 102 in FIG. 3 differs from exhaust gas purification apparatus 100 in FIG. 1 in that exhaust gas purification apparatus 102 does not include catalytic converter 20 itself.

Figure 4:
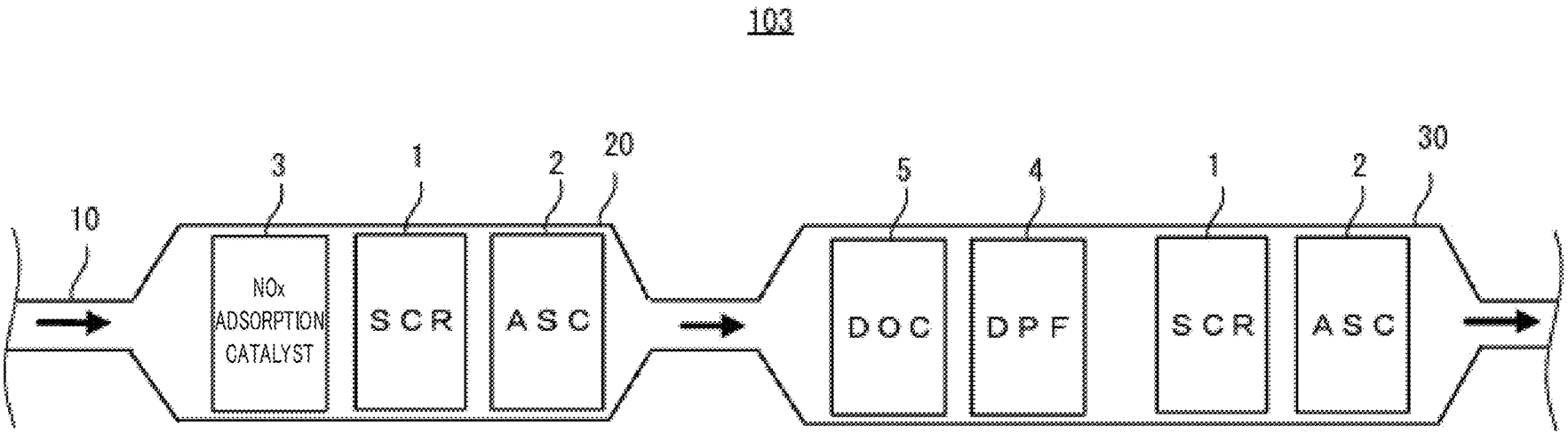
FIG. 4 schematically illustrates the configuration of an exhaust gas purification apparatus according to Comparative Example 3 of the present disclosure.

FIG. 4 is a schematic diagram illustrating the configuration of exhaust gas purification apparatus 103 as Comparative Example 3. Exhaust gas purification apparatus 103 in FIG. 4 differs from exhaust gas purification apparatus 100 in FIG. 1 in that exhaust gas purification apparatus 103 includes NOx adsorption catalyst 3 on the upstream side of SCR catalyst 1 in catalytic converter 20 and includes DOC 5, instead of NOx adsorption catalyst 3, in catalytic converter 30.

The configurations of exhaust gas purification apparatuses 101 to 103 in Comparative Examples 1 to 3 have been described above.

Exhaust gas purification apparatuses 100 and 103 have a configuration in which NOx adsorption catalyst 3 is added to exhaust gas purification apparatus 101.

Here, in a case where exhaust gas purification apparatuses 100 and 103 are compared, exhaust gas purification apparatus 100 is capable of suppressing NOx emissions more effectively than exhaust gas purification apparatus 103 due to Reasons 1 and 2 described below.

(Reason 1)

In exhaust gas purification apparatus 103, the temperature of exhaust gas flowing into NOx adsorption catalyst 3 becomes high in comparison with that in exhaust gas purification apparatus 100, and thus, the NOx adsorption capacity decreases and the release of NOx is started before SCR catalyst 1 is activated.

(Reason 2)

The NOx purification amount of SCR catalyst 1 on the upstream side (in catalytic converter 20) is not zero even at the time of a low temperature. The NOx adsorption capacity of NOx adsorption catalyst 3 is not as large, and in exhaust gas purification apparatus 103, NOx discharged from the internal combustion engine flows directly into NOx adsorption catalyst 3, which leads to over-capacity at an early stage.

Figure 5:
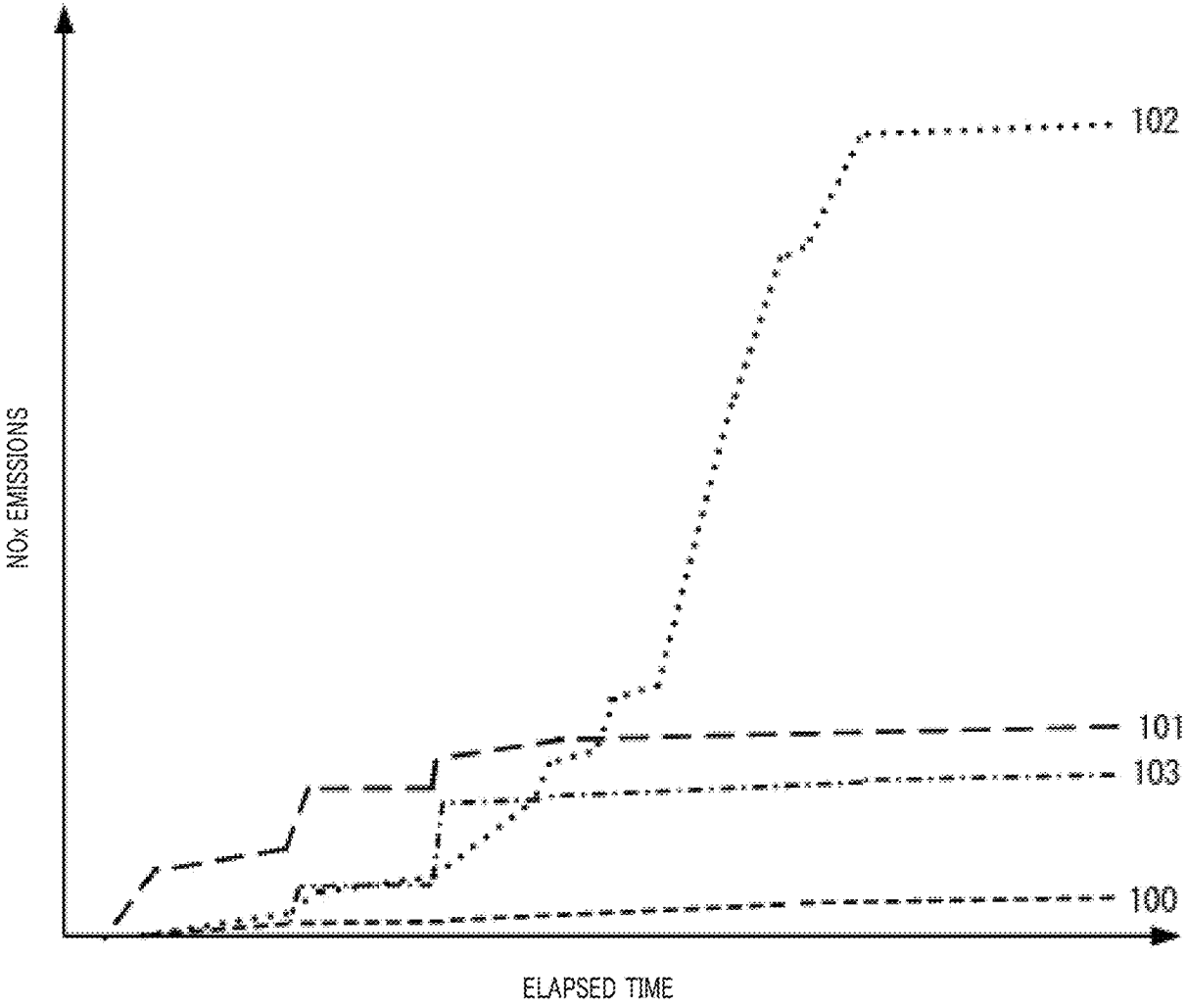
FIG. 5 is a graph illustrating temporal changes in the respective NOx emissions for the exhaust gas purification apparatuses according to the embodiment and Comparative Examples 1 to 3 of the present disclosure.

Next, FIG. 5 illustrates temporal changes in the respective NOx emissions for exhaust gas purification apparatuses 100 to 103. Note that, in FIG. 5, it is assumed that the longer the elapsed time, the higher the temperature of exhaust gas.

Exhaust gas purification apparatus 101 does not include NOx adsorption catalyst 3, and therefore cannot suppress NOx emissions at the time of a low temperature.

Exhaust gas purification apparatus 102 includes only one SCR catalyst 1, and therefore cannot suppress NOx emissions after NOx adsorption catalyst 3 becomes over capacity.

Since NOx adsorption catalyst 3 is disposed on the most upstream side, exhaust gas purification apparatus 103 starts releasing NOx before the activation of SCR catalyst 1.

In exhaust gas purification apparatus 100, NOx adsorption catalyst 3 and SCR catalyst 1 complement each other, and the maximum decrease in NOx emissions can be achieved.

As described above, exhaust gas purification apparatus 100 in the present embodiment is an exhaust gas purification apparatus that purifies exhaust gas discharged from an internal combustion engine, and is characterized by including, in order from an upstream side in a flow direction of the exhaust gas in exhaust pipe 10, SCR catalyst 1 (first selective catalytic reduction catalyst), NOx adsorption catalyst 3, and SCR catalyst 1 (second selective catalytic reduction catalyst).

With this feature, in exhaust gas purification apparatus 100 in the present embodiment, SCR catalyst 1 is activated due to a temperature rise of exhaust gas when NOx is released in NOx adsorption catalyst 3, with the result that NOx to be discharged into the atmosphere can be decreased. That is, exhaust gas purification apparatus 100 in the present embodiment is capable of suppressing NOx emissions at the time of a low temperature more effectively due to the appropriate arrangement of two SCR catalysts 1 and NOx adsorption catalyst 3.

Note that, the present disclosure is not limited to the embodiment described above, and various variations can be made without departing from the gist thereof.

INDUSTRIAL APPLICABILITY

The exhaust gas purification apparatus in the present disclosure is useful for the technique of purifying exhaust gas.

REFERENCE SIGNS LIST

1 SCR catalyst
2 ASC
3 NOx adsorption catalyst
4 DPF
5 DOC
10 Exhaust pipe
20, 30 Catalytic converter
100 to 103 Exhaust gas purification apparatus

The invention claimed is:

1. An exhaust gas purification apparatus that purifies exhaust gas discharged from an internal combustion engine, the exhaust gas purification apparatus comprising, in order from an upstream side in a flow direction of the exhaust gas in an exhaust pipe:

a first selective catalytic reduction catalyst;
a first ammonia slip catalyst;
an NOx adsorption catalyst;
a second selective catalytic reduction catalyst,
a second ammonia slip catalyst, wherein the first selective catalytic reduction catalyst and the first ammonia slip catalyst are provided in a first catalytic converter, and the NOx adsorption catalyst, the second selective catalytic reduction catalyst and the second ammonia slip catalyst are provided in a second catalytic converter.

2. The exhaust gas purification apparatus according to claim 1, further comprising a particulate filter provided on a downstream side of the NOx adsorption catalyst and on an upstream side of the second selective catalytic reduction catalyst.

* * * * *